United States Patent [19]

Kelly

[11] 4,261,797

[45] Apr. 14, 1981

[54] COKE OVEN DOOR AND SUPPORT APPARATUS THEREFOR

[75] Inventor: Calvin E. Kelly, Franklin Township, Westmoreland County, Pa.

[73] Assignee: United States Steel Corporation, Pittsburgh, Pa.

[21] Appl. No.: 122,532

[22] Filed: Feb. 19, 1980

[51] Int. Cl.[3] ..... C10B 25/06; C10B 25/12

[52] U.S. Cl. ..... 202/248; 110/173 R

[58] Field of Search ..... 202/248; 110/173 R; 212/4

[56] References Cited

U.S. PATENT DOCUMENTS

| | | | |
|---|---|---|---|
| 1,915,937 | 6/1933 | Lecocq | 202/248 |
| 2,759,884 | 8/1956 | Gillott | 202/248 |
| 3,486,986 | 12/1969 | Freund | 202/245 |

*Primary Examiner*—Frank W. Lutter
*Assistant Examiner*—Roger F. Phillips
*Attorney, Agent, or Firm*—William F. Riesmeyer, III

[57] ABSTRACT

Apparatus is provided for support of a self-sealing door on a horizontal coke oven and for guiding installation of the door on the oven. A single pair of hangers are provided for attachment to the oven adjacent opposite vertical sides of the door opening. At least one axially rotatable member is mounted on the door for engaging the hangers and providing movement of the door therealong in a horizontal direction toward the oven. The axially rotatable member is located in a position on the door so that the door will be suspended in a completely vertical attitude on the hangers and may then be rolled into contact with the frame at repeatable, accurate positions to obtain better sealing.

7 Claims, 7 Drawing Figures

COKE OVEN DOOR AND SUPPORT APPARATUS THEREFOR

BACKGROUND OF THE INVENTION

This invention relates to coke oven doors, and particularly to apparatus for support and guiding of a door on installation in a horizontal coke oven.

Conventional equipment for support and installation of coke oven doors is of two types. A first type involves placement of two or more pairs of hangers at spaced elevations on the frame for receiving fixed support bars of the door itself. The door is lifted and placed on the hangers by a pusher, or door machine, which then slides the door on the hangers into position against the frame. Subsequently, the latching mechanisms on the door are engaged and torqued to apply pressure on the seal. There are two major disadvantages to this type of support mechanism. First, it is virtually impossible to align the two pairs of hooks properly so as to prevent tilting of the door from top to bottom with respect to the frame. Secondly, even if the hooks are aligned properly, the door machine itself will likely place the door in a canted position on the hooks. Then, latching forces which are applied to the door are used partially at least to overcome friction of the slidable supports on the hangers to correctly align the door against the frame. The remaining latching force then will vary depending on the position of the door resulting in non-uniform sealing pressures each time the door is installed. A second type of support mechanism consists of a single pair of hangers extending from the oven and a roller support mounted on the door. Such a design is shown in U.S. Pat. No. 3,486,986, Freund. The roller is part of the latching mechanism in which the weight of the door forces the roller out against a stop at the remote end of the hangers to apply pressure on the seal. This design has the disadvantage that the roller does not support the door in an exact vertical attitude on the hangers. The door machine must remain engaged with the door to align it on the hangers and then to lower it and simultaneously move it into engagement with the frame. It is apparent that the alignment of the door in this type of support depends on the movement of the door machine and the positioning of the support against the stop of the hangers. As a result, the alignment of the door with the frame varies each time the door is installed and prevents effective sealing.

It is therefore a primary object of this invention to provide an apparatus for supporting and guiding a self-sealing door for a horizontal coke oven so as to position the seal of the door frame each time the door is installed.

SUMMARY OF THE INVENTION

According to this invention an apparatus is provided for supporting a self-sealing door in a door opening on a horizontal coke oven and for guiding installation of the door into the opening. The apparatus includes a single pair of hangers for attachment to the oven. The hangers provide upward facing parallel horizontal support surfaces extending longitudinally from the oven in an exterior direction normal to the wall of the oven containing the door opening. The hanger support surfaces are located substantially equidistant from and at substantially the same elevation along opposite vertical sides of the oven door opening, i.e. so as to support the door so that its vertical sides are properly aligned with the vertical sides of a frame bounding the opening.

At least one axially rotatable member is provided for engaging the support surfaces of the hangers in a fashion so as to be movable back and forth in the longitudinal direction of the support surfaces of the hangers. Means is provided for attaching the axially rotatable member to an exterior face of the door on an upper half, i.e. at or above the mid-point thereon. The attachment means fixes the position of the rotatable member in horizontal directions normal and parallel to the hangers at a location on the door so that the door will remain in a completely vertical attitude when fully suspended on the hangers. The attachment means also fixes the elevation of the member on the door at least when the door is suspended on the hangers under its own weight.

Finally, the support surfaces of the hangers are of sufficient length so that a sealing edge of the door will not be in contact with the door frame when the door is placed on the end of the hangers remote from the oven. Thus, after the door is suspended on the hangers under its own weight without support from a pusher or door machine, it remains vertical and then may be pushed horizontally into contact with the door frame at an accurate repeatable location. This provides better sealing when latching forces are applied because the door seal makes metal-to-metal contact with the frame each time it is installed and does not contact an uneven surface where carbon build-up has occurred around the seal of a door previously installed on the oven.

DESCRIPTION OF THE PREFERRED EMBODIMENT

Figure 2:
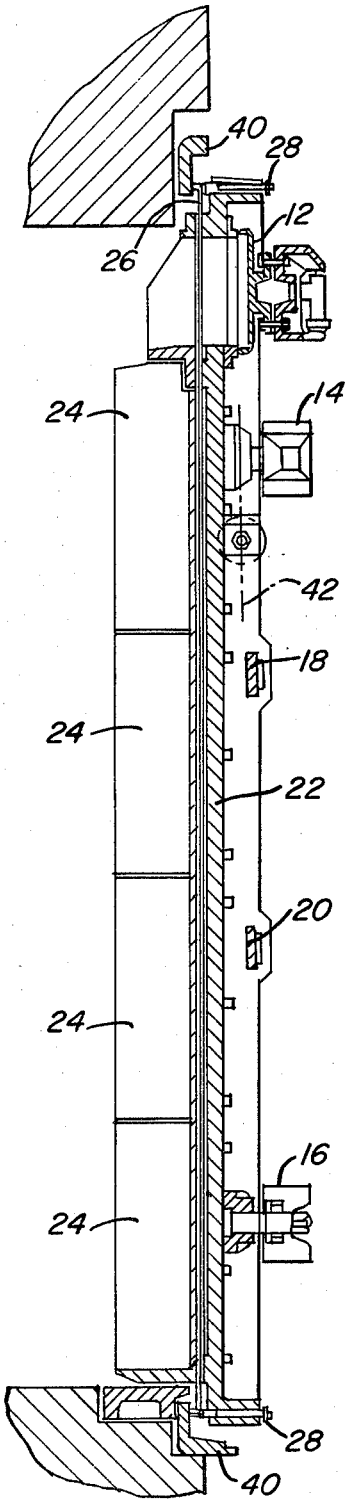
FIG. 2 is a view taken at 2—2 of FIG. 1.
Figure 1:
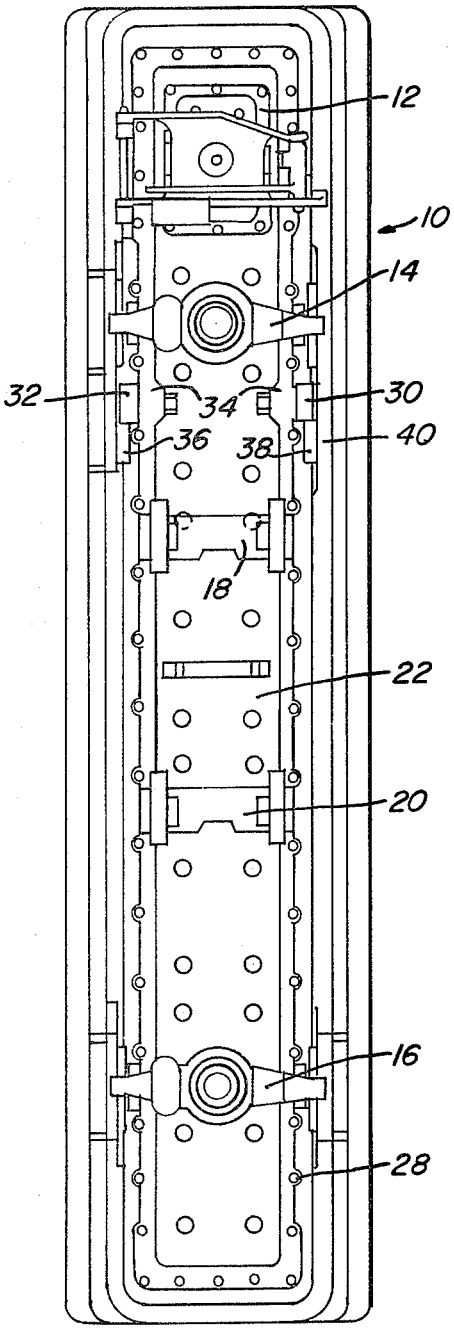
FIG. 1 is a front elevation view of a pusher side coke oven door together with the apparatus of this invention.

FIGS. 1 and 2 show a self-sealing door 10 for the pusher side of a horizontal coke oven. The door has a leveler door 12, upper and lower latches 14, 16, top and bottom lift bars 18, 20, a metal plate 22 supporting a series of flue plug sections 24 and a picture frame seal 26 to be pressed by spring plungers 28.

Figure 3:
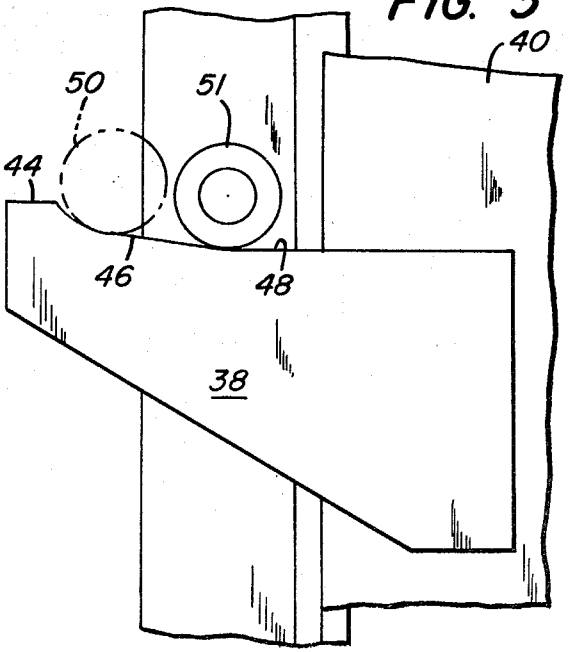
FIG. 3 is a partial side elevation view of a roller support member and a hanger protruding from the oven.

The apparatus of this invention includes rollers 30, 32 journaled in housings 34 at about the elevation of the upper latch on the door. The rollers are freely rotatable and ride on hangers 36, 38 attached to the door frame 40 bounding the oven opening. The axes of the rollers are located in a vertical plane 42 (FIG. 2) substantially through the center of gravity of the door. FIG. 3 is a schematic end elevation view of one of the rollers and hangers. The hanger preferably has a stop 44 and a tapered portion 46 leading downward to horizontal support surface 48. The door is first placed on the hangers so that the roller is located at position 50. The door then moves forward under its own weight permitting the door to roll on the hangers into final position in the door opening as shown by position 51 of the roller. This reduces the possibility of later skewing if the hangers were completely horizontal i.e. twisting about a vertical axis. Pushing the door on completely horizontal hangers e.g. by actuation of the latching device on the pusher machine increases the possibility of lateral twisting. The tapered hanger which preferably has a slope of 10°-20° from horizontal, allows the door to roll under its own weight into abutment against the frame.

Figure 5:
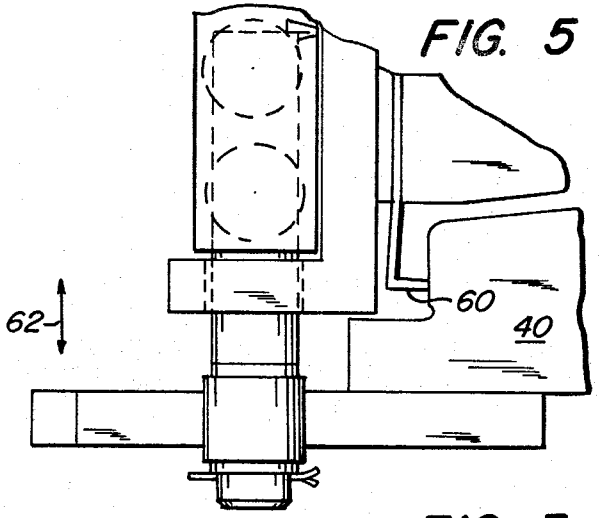
FIG. 5 is a top view of the apparatus of FIG. 4.
Figure 6:
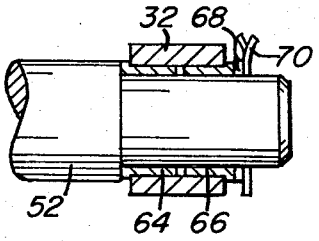
FIG. 6 is a cross-sectional view of one of the rollers of FIG. 4.
Figure 7:
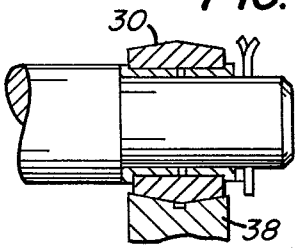
FIG. 7 is a cross-sectional view of one of the rollers of an alternate embodiment.
Figure 4:
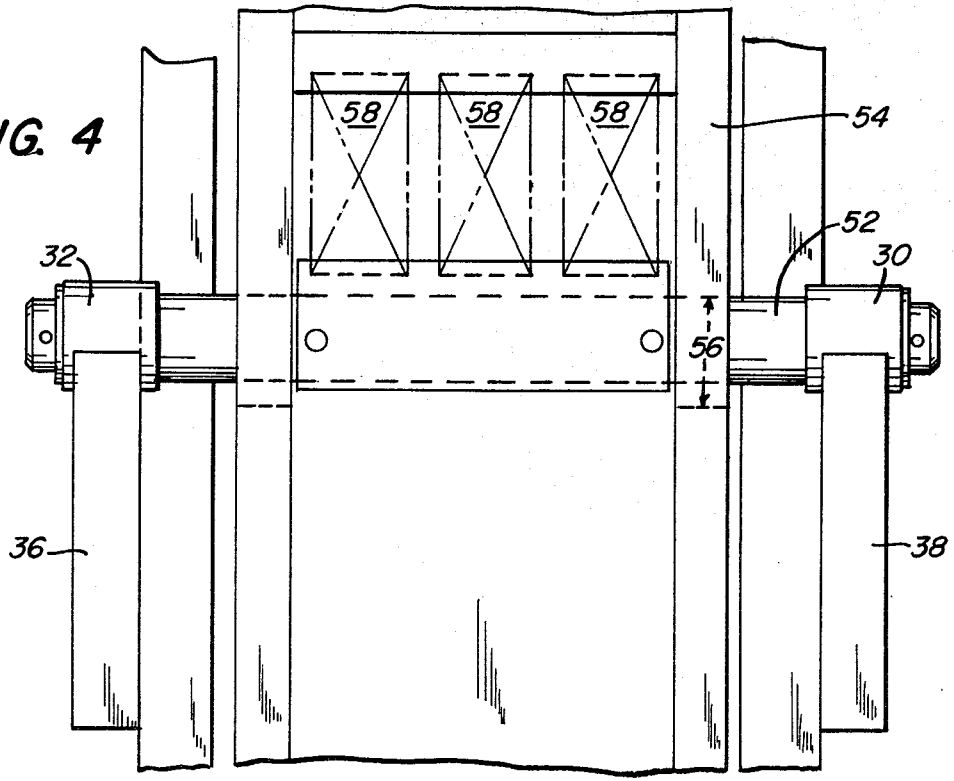
FIG. 4 is a partial front elevation view of a door showing a preferred form of the invention.

Referring to FIGS. 4, 5 and 6 showing a partial front elevation view in schematic form of a portion of a door having a preferred form of the invention. Rollers 30, 32 are rotatably mounted on fixed crossbar 52 housed in bracket 54 attached to the exterior face of the door. Bracket 54 has a vertically elongated slot 56 which permits upward or downward travel of the crossbar. Springs 58 resist upward movement of the crossbar to absorb shock when the door is placed on the hangers 36, 38. The upper end of slot 56 acts as a stop for limiting upward travel of the crossbar to fix the elevation of the door when it is resting fully under its own weight on the hangers. FIG. 5 shows sealing edge 60 engaging the doorframe 40 when the door is in final position. The position of the door laterally in the direction of arrow 62 may be determined by guide means as shown in U.S. Pat. No. 4,125,438 of common ownership as the application herein. Another lateral guide means may be provided by the embodiment shown in FIG. 7 when hangers 36, 38 (only one shown) are in the form of tracks which guide rollers 30, 32 (only one shown) prevent lateral movement of the door in a horizontal direction parallel to the plane of the door opening. Conceivably a railroad wheel and track arrangement could also be used as well as many other variations of design for performing the same function.

Rollers 30, 32 are supported on each end of crossbar 52 by low friction bushings 64, 66 and secured by washer 68 and cotter pin 70.

I claim:

1. Apparatus for supporting and guiding a door during installation thereof in a door opening of a coke oven, said apparatus providing accurate alignment of a sealing edge of the door with respect to a frame bounding said opening so as to minimize gaseous emissions therefrom when said sealing edge is pressed against the frame by a door latching mechanism, said apparatus comprising:

a single pair of hangers for attachment to said oven so as to provide upward facing parallel horizontal support surfaces extending longitudinally from said oven in an exterior direction normal thereto, said surfaces being substantially equidistant from and substantially at the same elevation along opposite vertical sides of said door opening in said oven, at least one axially rotatable member for engaging the support surfaces of said hangers so as to be movable back and forth in the longitudinal direction thereon, means for attaching said member to an exterior face of the door on an upper half thereon so as to remain, at a fixed elevation on said door at least when said door is fully suspended thereby on the hangers, and at a fixed position on said door in horizontal directions parallel and normal to said hangers so that the axis of said member lies in a vertical plane through the center of gravity of said door in a direction normal to said opening, said member being independent from and not connected to any movable parts of said door latching mechanism, the support surfaces of said hangers being of sufficient length so that said sealing edge of the door will not be in contact with the frame when the door is placed on the hangers adjacent an end thereof remote from said oven, and means for guiding said door so as to prevent twisting thereof about a vertical axis as said door moves in a longitudinal direction on said hangers.

2. The apparatus of claim 1 wherein each of said hangers further comprises an upwardly facing surface sloping from an upper end remote from said oven to a lower end adjacent thereto, said sloping surface joining the horizontal support surface of each hanger at the end thereof remote from said oven so that said door will roll in the longitudinal direction of said hangers into abutment against said frame.

3. The apparatus of claim 1 wherein said means for preventing lateral movement includes track-type support surfaces on said hangers, said member engaging said surfaces so as to prevent lateral movement of said door thereon.

4. The apparatus of claim 1 wherein said member is movable upward and downward in said attachment means in a vertical direction with respect to said door when said door is suspended on the hangers, and further comprising means for resisting upward movement of said member when said door is first placed on the hangers so as to reduce shock thereagainst, and a stop for limiting upward travel of said member so that said door will be positioned accurately at the proper elevation adjacent said door opening when the door is fully suspended on the hangers.

5. A door for closing an opening in a horizontal coke oven, said door having a sealing edge and a latching mechanism for pressing said edge against a frame bounding said opening to prevent escape of gases therebetween, said door comprising:

at least one axially rotatable member by which said door may be suspended adjacent said oven opening on a single horizontal axis parallel thereto, said member being rotatable in a direction so that said door will be freely movable in a horizontal direction normal to said oven, and means for attaching said member to an exterior face of the door in fixed position in horizontal directions normal and parallel to said oven and at a location such that the axis of said member lies in a vertical plane through the center of gravity of said door in a direction normal to said oven opening said member being located at an elevation on an upper half of the door and being independent of and not connected to any movable parts of said latching mechanism.

6. The door of claim 5 wherein said member comprises a pair of rolls mounted adjacent opposite sides of said door in a horizontal direction parallel to the exterior face thereof, the longitudinal axes of said rolls being located substantially in a vertical plane through the center of gravity of the door when suspended adjacent said oven.

7. The apparatus of claim 5 or 6 wherein said member is movable upward and downward in said attachment means in a vertical direction with respect to said door when said door is suspended adjacent the oven, and further comprising means for resisting upward movement of said member when door is first suspended so as to reduce shock of suspension of the door, and a stop for upward travel of said member so that said door will be positioned accurately at the proper elevation when fully suspended under its own weight.

* * * * *